US008219001B2

(12) United States Patent
Sendo et al.

(10) Patent No.: US 8,219,001 B2
(45) Date of Patent: Jul. 10, 2012

(54) IMAGE FORMING APPARATUS PROVIDED WITH TRANSFER AND SEPARATION DEVICE

(75) Inventors: Hiroshi Sendo, Toyokawa (JP); Toshiaki Tomino, Hachioji (JP); Kouki Takahashi, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 512 days.

(21) Appl. No.: 12/434,741

(22) Filed: May 4, 2009

(65) Prior Publication Data

US 2009/0279918 A1 Nov. 12, 2009

(30) Foreign Application Priority Data

May 12, 2008 (JP) ..... 2008-124525

(51) Int. Cl.
*G03G 15/14* (2006.01)
*G03G 15/16* (2006.01)
*G03G 21/00* (2006.01)

(52) U.S. Cl. ..... 399/121; 399/45; 399/313

(58) Field of Classification Search ..... 399/45, 399/121, 297, 312, 313, 315
See application file for complete search history.

(56) References Cited

U.S. PATENT DOCUMENTS 5,666,624 A 9/1997 Kanesawa et al.
5,873,019 A * 2/1999 Mizuishi ..... 399/313
6,044,244 A 3/2000 Watanabe et al.
6,389,242 B1 5/2002 Watanabe
6,760,565 B2 7/2004 Watanabe et al.
7,440,720 B2 10/2008 Takehara
7,505,725 B2 3/2009 Katayama et al.
7,606,507 B2 * 10/2009 Soshiroda ..... 399/66

FOREIGN PATENT DOCUMENTS

EP 0 899 625 A2 3/1999
EP 1 400 865 A1 3/2004
JP 1-152484 A 6/1989
JP 05061365 A * 3/1993
JP 07-261577 A 10/1995

(Continued)

OTHER PUBLICATIONS

Japanese Office Action dated Feb. 23, 2010 and English translation thereof in counterpart Japanese Application No. 2008-124525.

(Continued)

*Primary Examiner* — David Gray
*Assistant Examiner* — Fred L Braun
(74) *Attorney, Agent, or Firm* — Holtz, Holtz, Goodman & Chick, PC

(57) ABSTRACT

An image forming apparatus includes: a drum-shaped image carrier; a transfer and separation device which includes a conveyor belt for conveying a transfer material, a transfer roller for supporting the conveyor belt, and a nip regulating roller that is disposed downstream of the transfer roller in a conveyance direction of the transfer material; a transfer region changing section adapted to change a downstream end of the transfer region in a conveyance direction of the transfer material by changing a position of the nip regulating roller; and a transfer pressure changing section which changes a transfer pressure that corresponds to a pressure by the transfer roller against the image carrier, wherein the transfer pressure changing section changes the transfer pressure in correspondence with the change of the downstream end of the transfer region by the transfer region changing section.

3 Claims, 6 Drawing Sheets

FOREIGN PATENT DOCUMENTS

| | | | | |
|---|---|---|---|---|
| JP | 08146860 | A | * | 6/1996 |
| JP | 08220928 | A | * | 8/1996 |
| JP | 9-160324 | A | | 6/1997 |
| JP | 10-10885 | A | | 1/1998 |
| JP | 11-038796 | A | | 2/1999 |
| JP | 11-38796 | A | | 2/1999 |
| JP | 11194629 | A | * | 7/1999 |
| JP | 2000305403 | A | * | 11/2000 |
| JP | 2002-156839 | A | | 5/2002 |
| JP | 2004239971 | A | * | 8/2004 |
| JP | 2005-234268 | A | | 9/2005 |
| JP | 2005258288 | A | * | 9/2005 |
| JP | 2007-079068 | A | | 3/2007 |

OTHER PUBLICATIONS

Japanese Office Action dated Jun. 29, 2010 and English translation thereof, issued in counterpart Japanese Application No. 2008-124525.

Extended European Search Report dated May 19, 2010, issued in counterpart European Application No. 09 15 9029.

* cited by examiner

IMAGE FORMING APPARATUS PROVIDED WITH TRANSFER AND SEPARATION DEVICE

RELATED APPLICATION

This application is based on Japanese Patent Application No. 2008-124525 filed on May 12, 2008 in Japanese Patent office, the entire content of which is hereby incorporated by reference.

BACKGROUND

1. Field of the Invention

The present invention relates to transfer and separation technique in an electrophotographic image forming apparatus.

2. Description of Related Art

In the electrophotographic image forming process, the toner image is transferred to a transfer material which is the recording paper, using an electrostatic force.

The main transfer methods include: the corona transfer method in which the back surface of the transfer material is corona charged and then transferring is performed; and a transfer method in which the transfer material is pressed onto an image carrier using conveyor belt or a roller to which transfer voltage has been applied.

The latter method is advantageous in that, transfer properties are good because transferring is done by bringing the transfer material into close contact with the image carrier and there is little image disturbance at the time of transfer. Thus, this method is now being frequently used in high quality image formation apparatuses.

Also, the transfer method in which the transfer material is brought into close contact with the image carrier by the conveyor belt has the advantage of stable conveyance because the transfer material is conveyed by the conveyor belt.

Image formation apparatuses in which transfer is done by bringing the transfer material in close contact with the image carrier using a conveyor belt are disclosed in Unexamined Japanese Patent Application Publication No. 10-10885, Unexamined Japanese Patent Application Publication No. 11-38796, and Unexamined Japanese Patent Application Publication No. 9-160324.

In the inventions disclosed in these publications, various measures, such as changing the contact width of the transfer material with the image carrier, have been proposed for improving transfer properties.

After transfer, the transfer material is separated from the image carrier, but in transfer using a conveyor belt, a conductive conveyor belt is used and the transfer material is separated from the image carrier by electrostatic suctioning of the transfer material onto the conveyor belt to which transfer voltage is being applied.

In the high speed process, it became clear that there was a problem with the conveyance of the transfer material in the separation section in which the transfer material is separated from the image carrier.

This problem is described using FIG. 3 which is the figure for describing an embodiment of the present invention.

It is to be noted that the terms "upstream" and "downstream" in the present specification are used with reference to the conveyance direction of the transfer material.

The transfer of the toner image is carried out in a transfer region extending in the conveyance direction of the transfer material. The transfer region herein refers to the region where the transfer material is brought in close contact with the image carrier, and in FIG. 3 it is a rectangular region in which the transfer material conveyance direction from the point AP which is the upstream contact start point to the point BP which is the downstream separation point is the short side, while the width direction which is the direction at right angles to the transfer material conveyance direction is the long side.

The transfer region is formed by the transfer roller 70 and the nip regulating roller 74 that is disposed downstream with respect to the transfer roller 70.

The transfer material S separates from the image carrier at point BP which is the downstream end of the transfer region.

The conveyor belt 71 is bent at the point CP by the nip regulating roller 74, but the transfer material S is held and conveyed by the conveyor belt 71 in the downstream section from the point CP and is conveyed smoothly on the conveyor belt 71.

In the case where regular paper is used, the recording sheet S is conveyed smoothly on the conveyor belt 71 in the manner described above.

However, in the case where the transfer material S is thick paper, because rigidity is high, the transfer material S moves forward at point CP and separates from the conveyor belt 74.

As a result, the upper surface of the transfer material that carries the toner image comes in contact with the conveyance guide and problems such as image disturbance or conveyance defects occur.

In the image formation apparatuses disclosed in Unexamined Japanese Patent Application Publication No. 10-10885, Unexamined Japanese Patent Application Publication No. 11-38796, and Unexamined Japanese Patent Application Publication No. 9-160324, transfer property has been improved but the aforementioned problem with separation has not been solved.

The object of the present invention is to supply an image forming apparatus which: solves the aforementioned problem which occurs in the separation section in which the transfer material separates from the image carrier; performs favorable transfer for various types of transfer material; and carries out smooth transfer of the transfer material in the separation section.

SUMMARY

The aforementioned objective is achieved by the following invention.

An image forming apparatus comprising: a drum-shaped image carrier; a transfer and separation device which comprises: a conveyor belt for conveying a transfer material; a transfer roller for supporting the conveyor belt; and a nip regulating roller that is disposed downstream of the transfer roller in a conveyance direction of the transfer material, wherein the transfer and separation device, nips the transfer material with the image carrier and the conveyor belt by pressing the conveyor belt and the transfer material against the image carrier with the transfer roller, and regulates a transfer region in which the transfer member is nipped by the image carrier and the conveyor belt with the nip regulating roller; and a transfer region changing section adapted to change a downstream end of the transfer region in a conveyance direction of the transfer material by changing a position of the nip regulating roller; wherein the transfer region changing section sets the nip regulating roller, at a first position at which the conveyor belt is supported such that a direction of separation of the conveyor belt from the image carrier at the downstream end of the transfer region coincides with a tangential direction with respect to the image carrier, or at a second position at which the downstream end of the transfer region is located upstream of the downstream end of the transfer region at a time when the nip regulating roller is set at the first position.

DETAILED DESCRIPTION OF THE PREFERRED EMBODIMENTS

The following is a description of the present invention based on an embodiment of the present invention, but the present invention is not limited to this embodiment.

Figure 1:
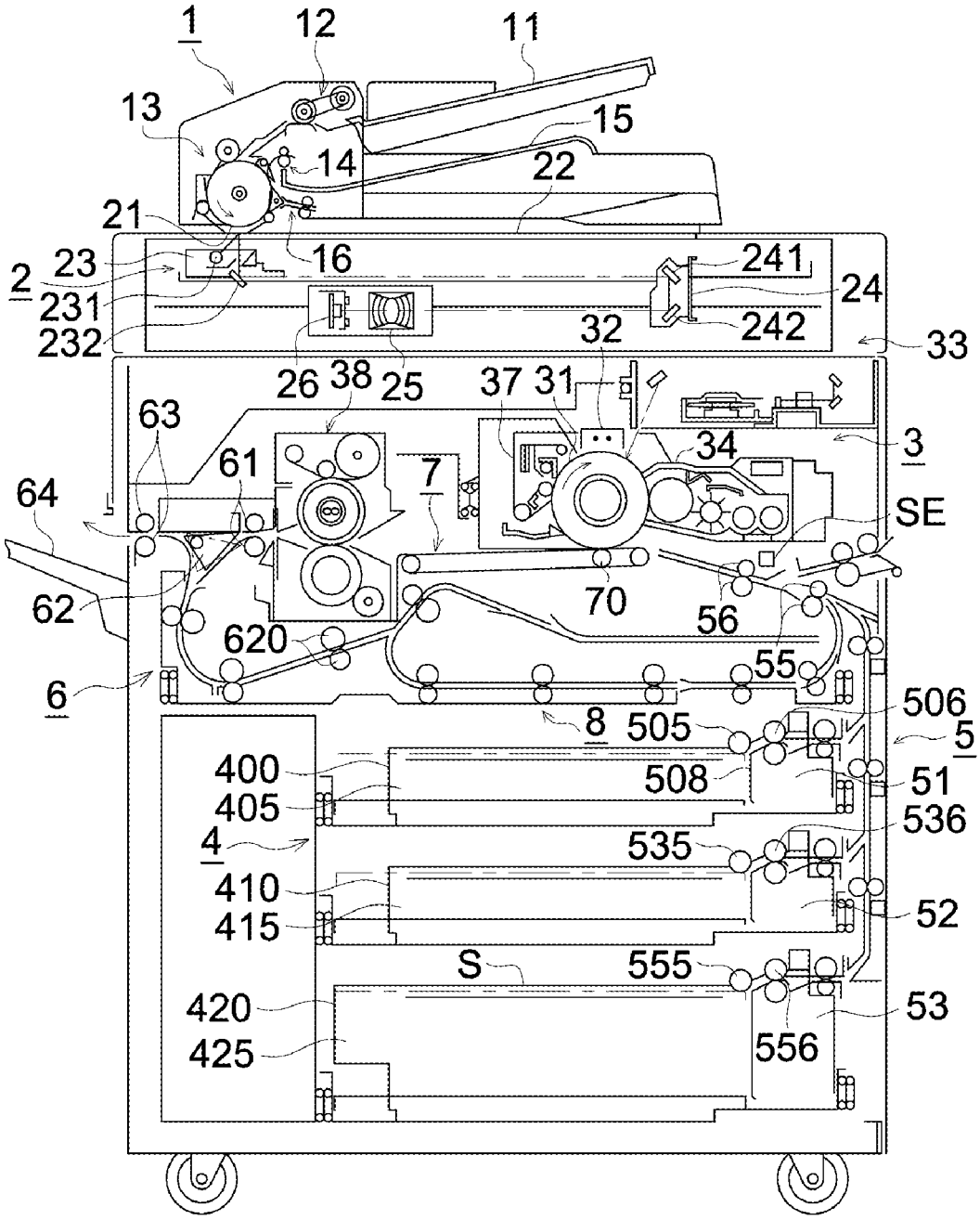
FIG. 1 shows the overall structure of the image forming apparatus according to an embodiment of the present invention.

FIG. 1 shows the overall structure of the image forming apparatus according to an embodiment of the present invention. The image forming apparatus of this embodiment comprises an automatic document feeding device 1 and inside the image forming apparatus main body, there are; an image reading device 2; an image forming section 3; a transfer material storage section 4; a sheet supply section 5; a reversal and sheet re-feeding section 6, and a circulation and conveyance section 8. The automatic document feeding device 1 feeds a document one sheet at a time and conveys the document to the image reading position and the document whose image has been read is subjected to discharge processing at a predetermined location.

The automatic document feeding device 1 comprises: a document mounting table 11; a document separating section 12 for separating the document mounted on the document mounting table 11; a document conveyance section 13 which includes multiple rollers for conveying the documents separated at the document separating section 12; a document discharge section 14 for discharging documents conveyed by the document conveying section 13; a document discharge table 15 for loading the document discharged by the document discharge section 14; and a document reversing section 16 made up of roller pairs for flipping the front and back of the document when reading images on both sides of the document.

The multiple sheets of document (not shown) loaded on the document loading table 11 are separated one by one, by the document separating section 12 and then conveyed towards the image reading position by the document conveying section 13.

The document reading device is provided under the document conveying section 13 and slit 21 of image reading device 2 is used to read images on the document.

The document whose images have been read is discharged onto the document discharge table 15 by the document discharge section 14.

The automatic document feeding device 1 is capable of document conveyance for reading both back and front of the document.

When the images on both back and front are to be read, the document for which images on one surface have been read is led to the document reversal section and the front and back of the document are reversed using reverse rotation control of the rollers when the rear end of the document is applied to the roller. Next, the image on the other surface is read at the document reading position by once again conveying the document using the document conveying section 13.

The process is repeated for the number of document sheets loaded on the document loading table 11. Further, the automatic document feeding device 1 is structured so as to be tiltable and when the automatic document feeding device 1 is raised and an upper side of the platen glass 22 is opened, the document can be loaded on the platen glass 22 and copying can be done.

The image reading device 2 is the section for reading images on the document and obtaining image data and comprises a first mirror unit 23 in which the slit 21, the lamp 231 which is a light source for irradiating the document and a first mirror 232 which reflects light reflected from the document are integrally formed; a second mirror unit 24 in which a second mirror 241 and a third mirror 242 which reflects light from the first mirror 232 are integrally formed; an imaging lens 25 which forms images using light reflected from the second mirror unit 24 on the image capturing element (CCD hereinafter) 26 which will be described below; and a linear CCD 26 which photoelectrically converts the light image formed by the imaging lens 25 and generates image signals.

The image information that has been subjected to appropriate image processing for the image signals is temporarily stored in memory (not shown).

In the aspect where the document that is being sent by the automatic document feeding device 1 is read by the image reading device 2, the first mirror unit 23 and the second mirror unit 24 are fixed at the positions shown in the figure.

On the other hand, in the aspect in which the images on the document loaded in the platen glass 22 are read, the first mirror unit 23 and the second mirror unit 24 are moved along the platen glass 22 while maintaining the light path length, to thereby read and scan the document.

The image forming section 3 forms images on the transfer material S based on image data obtained at the image reading device 2.

The image forming section 3 is the section which forms images using electrophotographic processes, and it comprises: a photoreceptor drum 31 which is the drum-shaped image carrier; a charger 32 which uniformly charges the surface of the photoreceptor drum 31, a laser writing system 33 which is an exposure section which operates based on the image data that has been subjected to image processing and is for forming latent images by exposing the surface of the photoreceptor drum 31; developing unit 34 which performs reverse development of the latent images formed on the photoreceptor drum 31 and thereby forms toner images; a transfer roller 70 for transferring the toner images onto the transfer material S; a cleaning section 37 for cleaning the photoreceptor drum 31 after the transfer process; a heat roller type fixing device 38 for fixing the toner images on the transfer material S; and a reversal discharge and re-feeding section 6 and circulation and conveyance section 8 which are described above.

In image formation done by the image formation section 3 having the structure described above, the photoreceptor drum 31 which is rotated in the direction of the arrow by an appropriate driving section (not shown) is uniformly charged in sequence by the charger 32 and then electrostatic latent images are formed by dot exposure using the laser writing system 33 and the toner images are formed using the developing device 34.

Subsequently, images are formed on the transfer material S by transferring the toner images onto the transfer material S using the transfer electric field from the roller 70. The images are formed so as to be superposed on the toner image region by synchronizing toner image formation with the timing of the sheet feeding operation associated with the start of rotation of the registration roller 56 which is the second sheet feeding section.

After this, the transfer material S to which the toner image has been transferred is separated from the photoreceptor drum 31 and the fixing process is carried out by the heating and pressing action of the fixing device 38 and the toner image is thereby fixed to the transfer material S.

On the other hand, the photoreceptor drum 31 which passes through the transfer region continues to rotate and is prepared for the next image formation after the residual toner is cleaned by the cleaning section 37.

The transfer material storage section 4 comprises feeding trays 400, 410 and 420 which are vertically arranged and which comprise storage sections 405, 415, and 425 which in turn are formed from storage containers for storing the transfer materials S in a stacked state. The storage sections 405, 415, and 425 are integrally formed with the corresponding sheet feeding units 51, 52 and 53. The feeding trays 400, 410 and 420 respectively store transfer materials S of different sizes.

For example, the setting may be such that, the sheet feeding tray 400 stores the standard size transfer materials S (letter size); 410 stores the A4 size transfer material S; and 420 stores the wide size transfer material S. All the transfer materials S are stored such that the short side is fed, or in other words such that the transfer material short side is aligned in the and conveyance direction.

The transfer materials S that are stored in these sheet feeding trays 400, 410 and 420 are not limited to regular paper, and recycled paper, coated paper, OHP sheets and the like may also be used. In addition, transfer material S of thickness varying from thin to thick may be stored.

The sheet feeding units 51, 52 and 53 are fixed in a loaded state in which the feeding trays are pushed into a predetermined location inside the device. The sheet feeding units 51, 52 and 53 comprise sheet feeding rollers 505, 535 and 555 which feed the transfer materials S one sheet at a time and separation rollers 506, 536 and 556 which are for preventing sheet overlap. The conveyance roller 55 is provided at the junction of the conveyance path of the transfer material fed from the transfer material storage section 4 and the circulation and conveyance section 8.

The sheet feeding section 5 is a conveyance section for conveying the transfer material S from each of the sheet feeding trays to the image forming section 3, and as shown in the figure, the sheet feeding section comprises multiple conveyance rollers such as 506, 536, 556 and the like, as well as conveyance guides.

The registration roller 56 of the sheet feeding section 5 conveys the transfer material S so as to synchronize with toner image formation on the photoreceptor drum 31.

The reversal discharge and re-feeding section 6 re-feeds the transfer sheet on which images have been formed at the time of reversal paper discharge or image formation on the back surface. The reversal discharge and re-feeding section 6 has a switching section which switches the conveyance path according to whether the transfer material S that has been discharged by the fixing and discharging roller 61 is discharged as it is to the paper discharge tray 64; whether the transfer material S discharged after front and hack have been flipped; or whether the transfer material S is to be re-fed for image formation on its back surface.

In the case where the transfer material S on which image formation has been carried out is to be discharged as it is, or in other words, with the image surface of the transfer material S being at the upper side, the switching section 62 is positioned at the position shown by the broken line in the figure. Further, in the case where the front and back surfaces of the transfer material S on which images have been formed are flipped, the switching section 62 is set at the position shown by the solid line in the figure. In this case, the transfer material S that is to be conveyed by the fixing and discharge roller 61 is first conveyed to the circulation and conveying section 8 side and after the transfer material S passes the switching section 62, it passes to the left of the switching section 62 and is discharged to the discharge tray 64 which is outside of the device.

In the case where image formation is carried out on the back surface of the transfer material S, the transfer material S that is conveyed by the fixing and discharge roller 61 is conveyed to the circulation and conveying section 8 by the conveyance rollers of the reversal discharge and re-feeding section 6 which is driven by the sheet discharge roller. Subsequently, a switchback is done and the front and back are flipped and then the transfer material S is circulated and conveyed to the registration roller 56 via the conveyance roller 55 at the junction.

Figure 2:
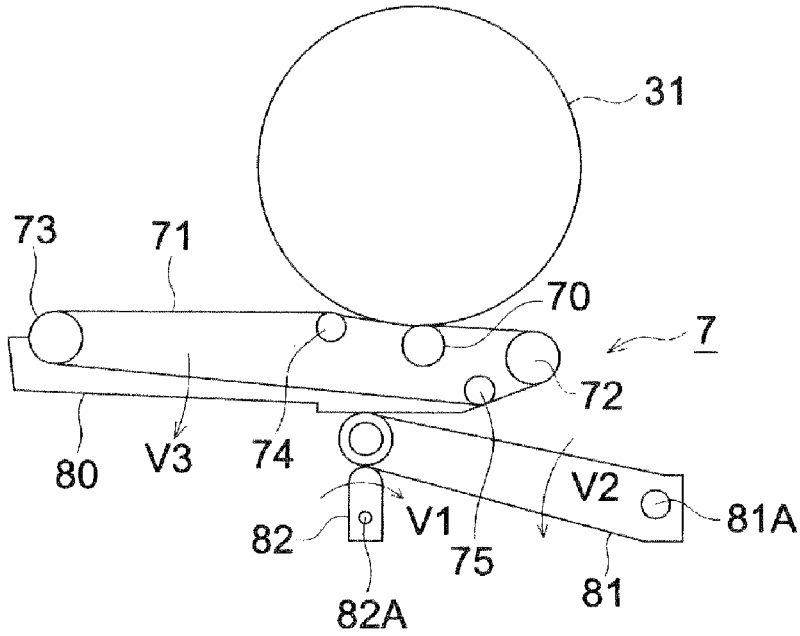
FIG. 2 shows the transfer and separation device.

FIG. 2 shows the transfer and separation device 7.

The transfer and separation device 7 comprises: a transfer roller 70; a conveyor belt 71; rollers 72 and 73 which support the conveyor belt 71; a nip regulating roller 74; a tension roller 75 and a support frame 80 which supports all these rollers.

Figure 3:
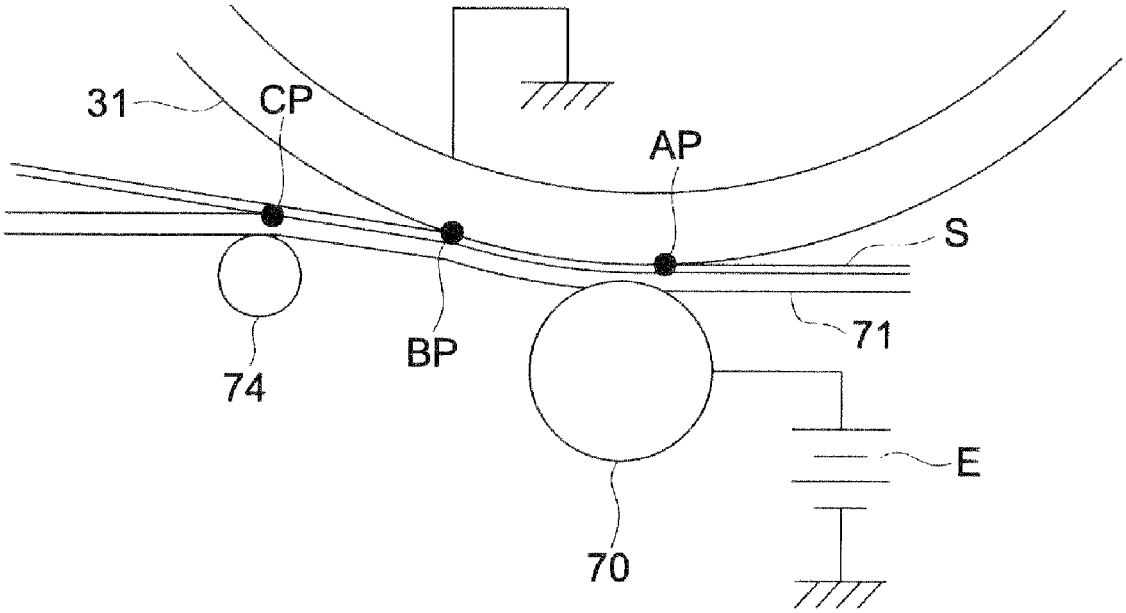
FIG. 3 is for describing the transfer and separation operation.

The transfer roller 70 and the conveyor belt 71 are made of high resistance rubber having a resistance approximately between $10^5$ Ω·cm and $10^{12}$ Ω·cm and a transfer voltage is applied to the transfer roller 70 by the power source E (refer to FIG. 3).

The support frame 80 can rotate, as shown by the arrow V3, about the rotational axis of the roller 73.

The support frame 80 is supported by the support frame 81 and is set at the position shown in the figure.

The support frame 81 can rotate as shown by the arrow V2 about the shaft 81A.

The left end of the support frame 81 is supported by a slidable operation lever 82. The operation lever 82 can be rotated as shown by the arrow V1 by being operated by an operator.

When the operation lever 82 is rotated by an operator as shown by the arrow V1, the support frame 81 rotates as shown by arrow V2 and the support frame 80 rotates as shown by arrow V3 due to this rotation of the support frame 81.

The transfer roller 70 and the conveyor belt 71 separate from the photoreceptor drum 31 due to the rotation of the support frame 80.

The operation, namely the operation in which the operation lever 82 is rotated as shown by the arrow V1 opens up the transfer region vicinity and is performed for clearing paper jams and the like.

The transfer and separation operation in the transfer and separation device 7 will be described with reference to FIG. 3.

The transfer material S is pressed by the transfer roller 70, via the conveyor belt 71 and brought into close contact with the photoreceptor drum 31. A transfer electric field is formed in the transfer region where the transfer material S is in close contact with the photoreceptor drum 31, and the toner image is transferred from the photoreceptor drum 31 to the transfer material S. The transfer region is the range from the point AP which is the point for start of contact at the upstream side for the transfer material conveyance direction, to the point BP which is point where the transfer material S separates from the photoreceptor drum 31.

At the point BP, the transfer material S and the conveyor belt 71 move in a tangential direction of a tangential line which contacts with the surface of the photoreceptor drum 31 at point BP and then they separate from the photoreceptor drum 31.

Transfer voltage is being applied to the transfer roller 70 by the power source E and thus the toner image on the photoreceptor drum 31 is transferred to the transfer material S in the transfer region.

The toner image is transferred from the photoreceptor drum 31 to the transfer material S in a transfer region having a predetermined width (Length AP–BP in the transfer material conveyance direction).

The nip regulating roller 74 regulates the width of the transfer region in which the transfer material S is brought in close contact with the photoreceptor drum 31 by adjusting the conveyor belt 71 to the photoreceptor drum 31.

The transfer material S that has passed through the transfer region formed by the nip of the photoreceptor drum 31 and the transfer roller 70 separates from the receptor drum 31 at the point BP where the conveyor belt 71 separates from the receptor drum 31.

At the point BP, resistance is high, but the transfer material S is electrostatically suctioned to the conductive conveyor belt 71 and so when the conveyor belt 71 separates from the photoreceptor drum 31, the transfer material S also separates from the photoreceptor drum 31.

The transfer material S that has been separated from the photoreceptor drum 31 is conveyed in a state where it is suctioned to the conveyor belt 71, but the conveyor belt 71 is bent at the position of the nip regulating roller 74.

The transfer material S is conveyed along the conveyor belt 71 which bends at the point CP.

A toner image is transferred to the transfer material S in the transfer and separation device using the operation described above, and the transfer material S to which an image has been transferred is separated from the photoreceptor drum 31 and conveyed to the fixing device 38 by the conveyor belt 71.

The nip regulating roller 74 is displaced vertically in accordance with the type of paper.

Figure 4A:
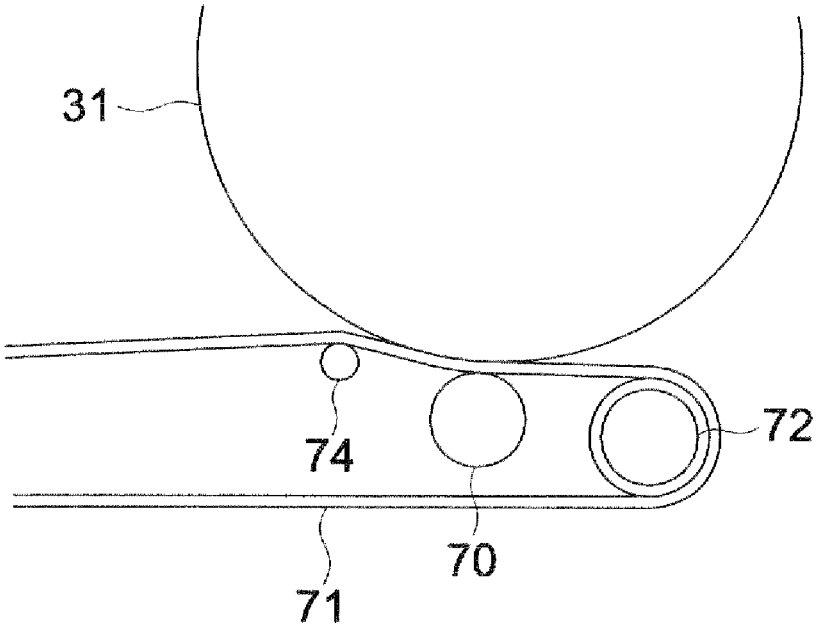
FIGS. 4*a* and 4*b* show the operation of the nip regulating roller.
Figure 4B:
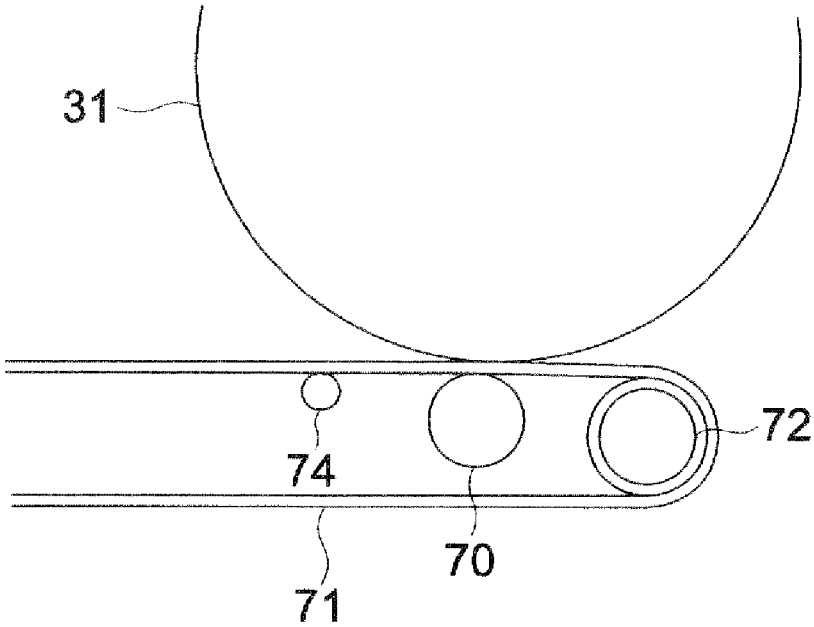

FIG. 4*a* and FIG. 4*b* show the operation of the nip regulating roller 74 and FIG. 4*a* shows the first position of the nip regulating roller 74 in the first mode in which regular paper or thin paper is passed through and image formation is done, while FIG. 4*b* shows the second position of the nip regulating roller 74 in the second mode in which thick paper is passed through and image formation is done.

In FIG. 4*a*, the nip regulating roller 74 is set at the raised first position and is at a position close to the surface of the photoreceptor drum 31 and the extent of the transfer region is large and the point BP is set at a downstream side position.

In the case where transfer material S formed from regular paper or thin paper is used, at the point BP where the conveyor belt 71 separates from the photoreceptor drum 31, it is important that at point BP, the conveyor belt 71 moves in parallel with the tangential line drawn on the surface of the photoreceptor drum 31 and separates from the photoreceptor drum 31.

When the conveyor belt 71 does not move parallel to the tangential line and separates from the photoreceptor drum 31, in some cases the transfer material S is not suctioned to the conveyor belt 71 but rather is suctioned to the photoreceptor drum 31 and conveyed.

That is to say, in some cases, separation defects occur.

In order to prevent this type of separation defect, in the case where the transfer material S is regular paper or thin paper, the nip regulating roller 74 is set such that at point BP, the conveyor belt 71 moves parallel to the tangential line and separates from the photoreceptor drum 31.

That is to say, the nip regulating roller 74 is set at the first position.

By setting the nip regulating roller 74 in this manner, separation of the transfer material S from the photoreceptor drum 31 can be ensured.

In the case where the images are formed on a transfer material S made from thick paper, the nip regulating roller 74 is set at a position that is further from the photoreceptor drum 31 than the first position, namely the second position in FIG. 4*b*.

In the state shown in FIG. 4*b*, there is little or no bending of the conveyor belt 71 by the nip regulating roller 74.

In the state shown in FIG. 4*a*, when a transfer material S made from thick paper is conveyed, the transfer material S separates from the conveyor belt 71 without bending at the position of the nip regulating roller 74 due to its strong rigidity and is conveyed in the upper left direction.

As a result, the unfixed toner on the transfer material S contacts the conveyance guide and the like and is disturbed and this causes image disturbance. Furthermore, conveyance defects are generated.

By setting the nip regulating roller 74 at the second position shown in FIG. 4*b*, these types of problems are solved.

It is to be noted that in the example shown in the figure, in the case where thick paper is used (in the case of FIG. 4*b*), there is little or no bending of the conveyor belt 71 at the position of the nip regulating roller 74. However, in the case of thick paper, by changing the position of the nip regulating roller 74 with respect to the photoreceptor drum 31, if the nip regulating roller 74 that is pressed to the conveyor belt 71 moves point BP in FIG. 3 further to the upstream side than in the case of regular paper or thin paper, the image and conveyance defects generated in the case of thick paper can basically be prevented.

Therefore, even in the case where the transfer material S is formed from thick paper, the nip regulating roller 74 may be brought in contact with the conveyor belt 71. That is to say, in the case where the transfer material is thick paper, by moving point BP further to the upstream side than in the case of regular paper or thin paper, the tangential direction of the photoreceptor drum 31 at the point BP becomes more horizontal and thus the conveyance direction of the transfer material S also becomes more horizontal.

The extent to which the BP in the case of thick paper is moved further to the upstream side than in the case of regular paper, can be suitably determined based on the structure of the transfer and separation device, the properties of the transfer material to be transferred and the like.

Figure 5A:
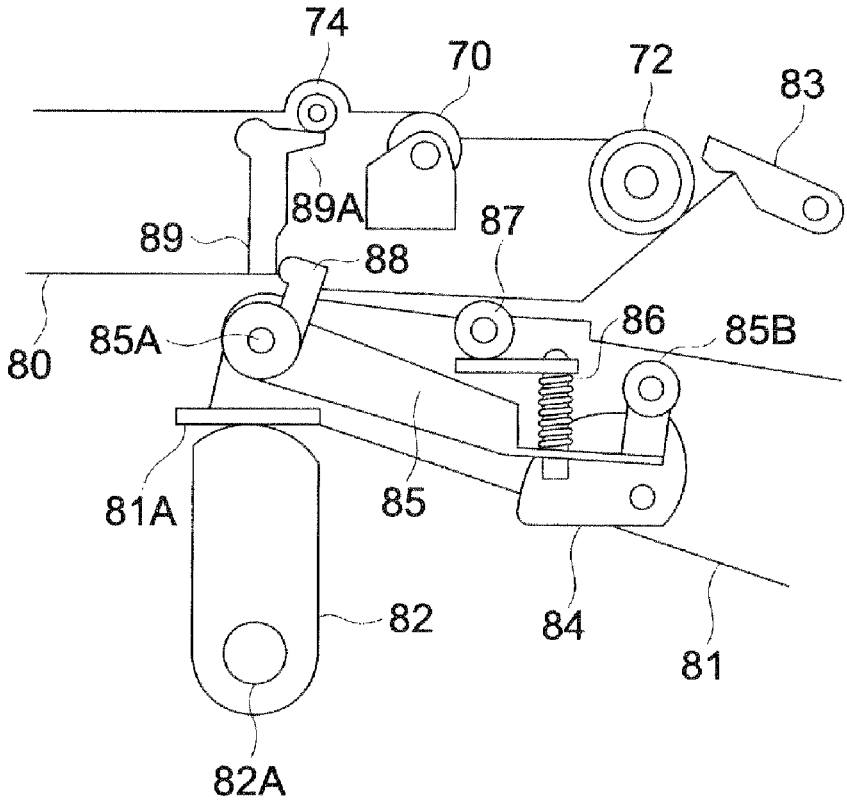
FIGS. 5*a* and 5*b* show the mechanism which moves the nip regulating roller and changes the points.
Figure 5B:
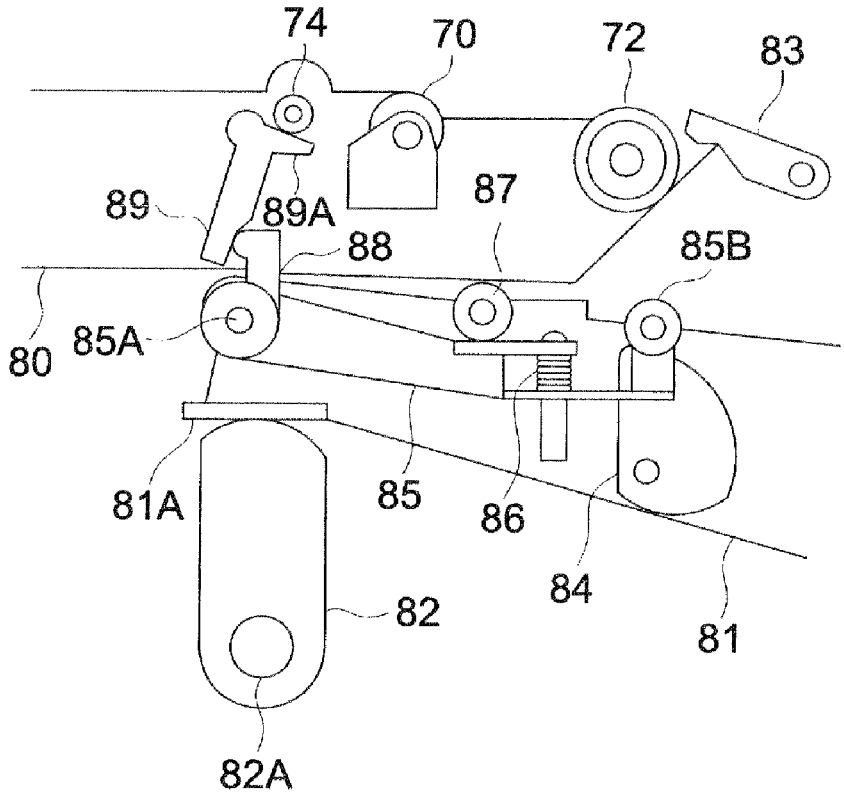

FIG. 5*a* and FIG. 5*b* show the mechanism for moving the nip regulating roller 74 and changing the point BP.

The transfer roller 70, the roller 72 and the nip regulating roller 74 are supported by the support frame 80.

It is to be noted that although this is not shown in FIG. 5*a* and FIG. 5*b*, as shown in FIG. 2, the roller 73 and the tension roller 75 are also supported by the support frame 80.

The support frame 81 has a cam 84 which is rotatable. The support frame 81 has at its left end portion, a lever 85 that is rotatable about the bearing 85A. The raise portion at the right end of the lever 85 has a roller 85D and the roller 85B is on top of the cam 84.

The lower end of a coil spring 86 is on top of the lever 85 while the upper end presses the roller 87 that is provided on the support frame 80.

The bearing 85A on the support frame 81 has an operation member 88 which rotates integrally with the lever 85 and the operation member 88 presses a rotor 89 and thereby rotates.

The protrusion portion that protrudes in the horizontal direction of the rotor 89 displaces the nip regulating roller 74 vertically. The rotor 89 is urged in the anticlockwise direction by a spring which is not shown and the nip regulating roller 74 is urged upwards by the rotor 89 and pushes up the conveyor belt 71.

83 is a hook that anchors the support frame 80 at a fixed upper limit position.

The transfer roller 70 is pressure-contacted with the photoreceptor drum 31 using the compression force of the coil spring 86, but the upper limit is controlled by the hook 83.

FIG. 5*a* shows the state of the transfer and separation device 7 in the case where the transfer material is regular paper or thin paper (first mode).

In FIG. 5*a*, the operation point of the cam 84 is at a low position. Therefore, the lever 85 is at a position where it rotates in the clockwise direction about the bearing 85A, and the coil spring 86 is in a state of low compression.

The force with which the coil spring 86 presses the support frame 80 is therefore weak and the contact pressure of the transfer roller 70 on the photoreceptor drum 31 is small. That is to say, transfer pressure is low.

Also, the operation member 88 and the lever 85 are at a position where they have rotated in the clockwise direction. Therefore, the rotor 89 is not pressed by the operation member 88 and the nip regulating roller 74 is at the upper position as shown in FIG. 4*a*.

The driving section which is not shown may, for example, be placed in the state of FIG. 5*b* (second mode) by the cam 84 being rotated in the clockwise direction by the motor.

In FIG. 5*b*, the lever 85 is rotated in the anticlockwise direction the roller 85*b* being pressed up. On the other hand, the support frame 80 is anchored by the hook 83 and thus the coil spring 86 is compressed.

As a result, the contact pressure of transfer roller 70 on the photoreceptor drum 31 will be increased. That is to say the transfer pressure becomes high.

In other words, the transfer of the toner image to the thick paper is performed with high transfer pressure.

The operation member 88 which is integral with the lever 85 is rotated in the anticlockwise direction, and when the rotor 89 is pressed, it rotates in the clockwise direction.

The nip regulating roller 74 is lowered by the rotation of the rotor 89 and is in the state shown in FIG. 5*b* and thus the point BP moves to the upstream side.

The operation lever 82 is rotated when the conveyance path in the vicinity of the transfer position is to be opened for clearing jams and the like.

The support frame 81 is rotated as shown by the arrow V2 about the bearing 81A by operating the operation lever 82 which is rotated in the clockwise direction, or in other words, in the V1 direction in FIG. 2. The support frame 80 rotates as shown by the arrow V3 and the right end portion of the support frame 80 is lowered and the transfer roller 70 and the conveyor belt 71 are separated from the photoreceptor drum 31 by a large distance and thus the conveyance path in the vicinity of the transfer region is opened.

The position of the nip regulating roller 74 described above can be switched in accordance with the thickness of the transfer material. For example, switching such as that shown in Table 1 can be carried out.

TABLE 1

| | | Basis weight | | |
|---|---|---|---|---|
| | | −100 g/m$^2$ | 100 g/m$^2$-200 g/m$^2$ | 200 g/m$^2$-300 g/m$^2$ |
| Transfer material | Regular paper<br>High quality paper<br>Coated paper | Nip regulating roller First position | | Nip regulating roller Second position |

In Table 1, "Up" is the position shown in FIG. 4*a* and "Down" is the position shown in FIG. 4*b*.

Figure 6:
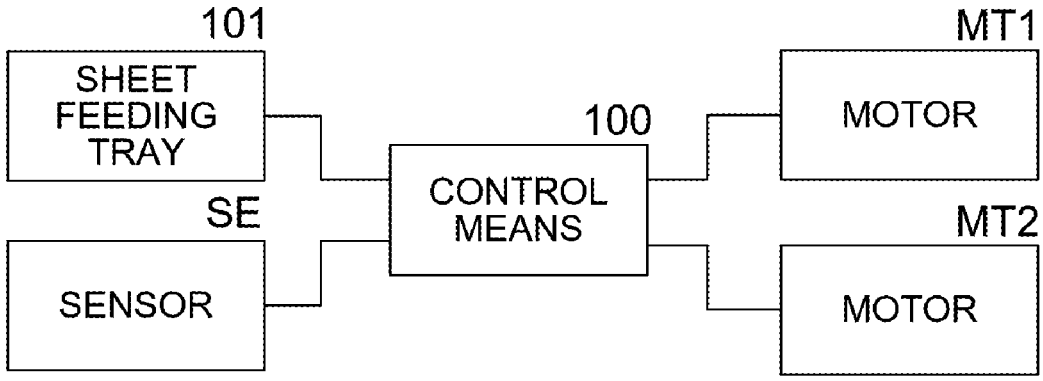
FIG. 6 is a block diagram showing the control system of the image forming apparatus according to an embodiment of the present invention.

FIG. 6 is a block diagram showing the control system of the image forming apparatus according to an embodiment of the present invention.

Figure 7:
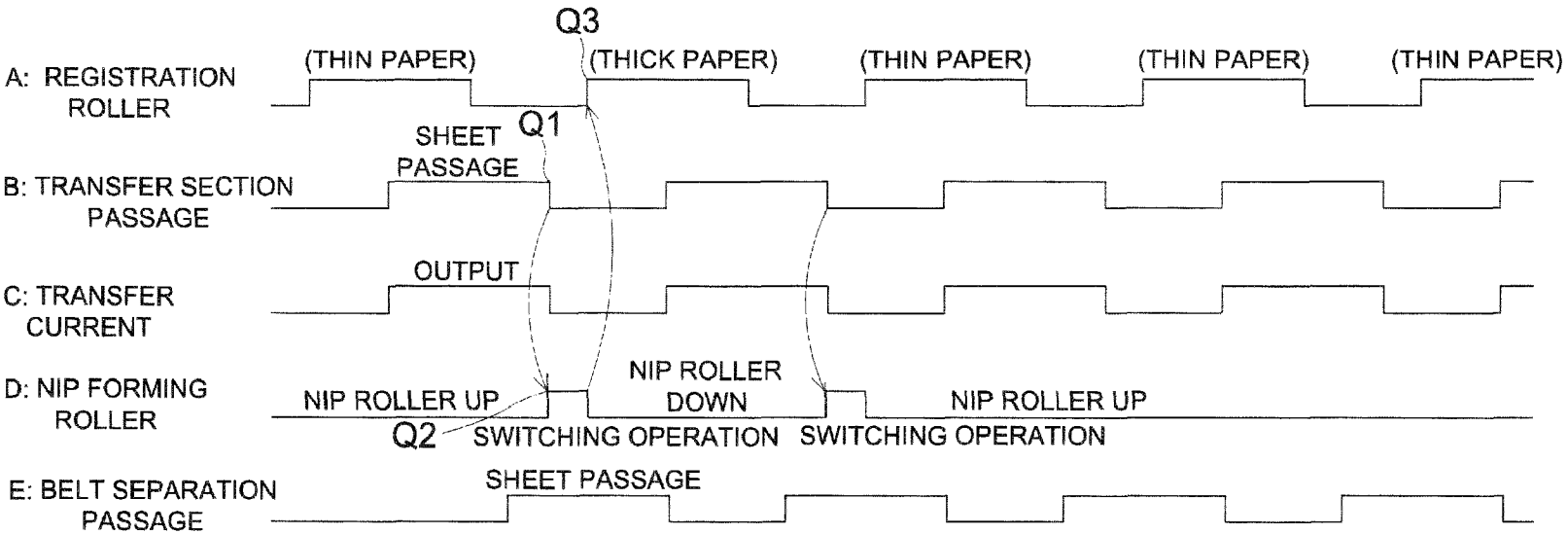
FIG. 7 is a timing chart for the operation of the transfer and separation device.

FIG. 7 is a timing chart for the operation of the transfer and separation device.

The control section 100 is a control section for controlling the image forming step as well as transfer region changing section for changing the position of the nip regulating roller 74.

The control section 100 is provided at the upstream portion of the registration roller 56 (refer to FIG. 1) and it controls the operations shown in FIG. 7 by controlling the motor MT1 which drives the registration roller and the motor MT2 which drives the cam 84 (refer to FIG. 5) based on the detection signal from the transfer sensor SE.

101 is the paper supply tray and the information for the transfer materials used for image formation that are loaded in the sheet supply tray is output to the control section 100.

In FIG. 7, A (registration roller) shows the operation of the registration roller 56 (refer to FIG. 1), and the high portion indicates the rotation of the registration roller. In addition, the information inside the parentheses indicates the thickness of the transfer material conveyed by the registration roller 56, and (thin paper) indicates regular paper or thin paper, while (thick paper) indicates thick paper.

B (transfer section passage) shows passage of the transfer material between the photoreceptor drum 31 and the transfer roller 70 and the high portion indicates transfer material passage.

D (nip regulating roller) indicates ON/OFF state of the motor MT2 which drives the cam 84 in FIG. 5 and the position of the nip regulating roller 74 is switched by turning ON the motor MT2 once. "Nip roller up" indicates the state shown in FIG. 5*a* and "Nip roller down" indicates the state shown in FIG. 5*b*.

E (point passage) indicates that the transfer material passes the point BP in FIG. 3 and the high portions indicate passage of the transfer material.

As shown in the figure, the transfer material passes through the transfer section with the same timing that the transfer current turns ON and thus transfer is carried out.

In the case where the information from the sheet feeding tray 101 indicates that the transfer material has been changed from regular paper to thick paper, the timing Q1 for the passage of the regular paper through the transfer section is used as a trigger and the motor MT2 operates and the nip regulating roller 74 is switched from the upper to the lower (Q2).

Next, startup (Q3) of the registration roller 56 which feeds thick paper is carried out using as a trigger, the signal which indicates completion of the setting of the conversion operation which starts at Q2, namely, the thick paper conveyance state (state shown in FIG. 4*b*) where the nip regulating roller 74 is lowered downward.

By controlling the position of the nip regulating roller 74 based on the transfer material detection signal from the sensor SE for each individual sheet of the transfer material that is continuously fed, the transfer and separation device 7 can be set to an ideal state without stopping the image formation process in order to change the point BP.

Thus, image formation can be performed in an ideal state without reducing image formation productivity.

As described above, in the embodiment of the present invention, the downstream end of the transfer region in which the transfer material separates from the image carrier is changed in accordance with the type of transfer material, and thus the conveyance direction of the transfer material at the point is changed in accordance with the type of transfer material.

Therefore, conveyance of the transfer material after separation is carried out smoothly and problems such as that of the unfixed toner on the transfer material contacting the conveyance guide and the like and generating conveyance defects are sufficiently prevented.

What is claimed is:

1. An image forming apparatus comprising:

a drum-shaped image carrier;

a transfer and separation device which comprises:

a conveyor belt for conveying a transfer material;

a transfer roller for supporting the conveyor belt; and a nip regulating roller that is disposed downstream of the transfer roller in a conveyance direction of the transfer material, wherein the transfer and separation device nips the transfer material with the image carrier and the conveyor belt by pressing the conveyor belt and the transfer material against the image carrier with the transfer roller, and regulates a transfer region in which the transfer material is nipped by the image carrier and the conveyor belt with the nip regulating roller;

a transfer region changing section adapted to change a downstream end of the transfer region in a conveyance direction of the transfer material by changing a position of the nip regulating roller, wherein the transfer region changing section (i) sets the nip regulating roller at a first position at which the conveyor belt is supported such that a direction of separation of the conveyor belt from the image carrier at the downstream end of the transfer region coincides with a tangential direction with respect to the image carrier, in a first mode in which the image forming apparatus forms an image on a transfer material having a first thickness, and (ii) sets the nip regulating roller at a second position at which the downstream end of the transfer region is located upstream of the downstream end of the transfer region when the nip regulating roller is set at the first position, in a second mode in which the image forming apparatus forms an image on a transfer material having a second thickness which is thicker than the first thickness; and a transfer pressure changing section which changes a transfer pressure that corresponds to a pressure by the transfer roller against the image carrier, wherein the transfer pressure changing section changes the transfer pressure in correspondence with the change of the downstream end of the transfer region by the transfer region changing section, and wherein the transfer pressure in the second mode is higher than the transfer pressure in the first mode.

2. The image forming apparatus of claim 1, wherein the nip regulating roller forms the transfer region by pressing the conveyance belt both in the first mode and the second mode.

3. The image forming apparatus of claim 1, wherein the first mode is a normal mode, the second mode is set in accordance with information indicating that the transfer material having the second thickness is to be passed through the image forming apparatus, and the second mode is reset to the first mode in accordance with information indicating that the passing through of the transfer material having the second thickness has terminated.

* * * * *